US005926670A

United States Patent [19]

Furuta et al.

[11] Patent Number: 5,926,670

[45] Date of Patent: Jul. 20, 1999

[54] IMAGE FORMING APPARATUS CLEANING AN INTERMEDIATE TRANSFER MEMBER CARRYING A CONCURRENTLY EXISTING PLURALITY OF TONER IMAGE PAGES

[75] Inventors: Hideya Furuta; Reo Munakata, both of Yokohama; Yoshihiro Sakai, Tokyo, all of Japan

[73] Assignee: Ricoh Company, Ltd., Tokyo, Japan

[21] Appl. No.: 09/002,827

[22] Filed: Jan. 5, 1998

[30] Foreign Application Priority Data

Jan. 6, 1997 [JP] Japan ..... 9-012016

[51] Int. Cl.[6] ..... G03G 15/01; G03G 15/16; G03G 21/00

[52] U.S. Cl. ..... 399/101; 399/302

[58] Field of Search ..... 399/66, 71, 101, 399/302

[56] References Cited

U.S. PATENT DOCUMENTS

| | | |
|---|---|---|
| 4,615,607 | 10/1986 | Yanagawa et al. . |
| 4,655,579 | 4/1987 | Adachi et al. . |
| 4,662,739 | 5/1987 | Sakai et al. . |
| 4,664,501 | 5/1987 | Koizumi et al. . |
| 4,690,542 | 9/1987 | Furuta et al. . |
| 4,742,371 | 5/1988 | Furuta et al. . |
| 4,746,950 | 5/1988 | Mamizuka et al. . |
| 4,750,017 | 6/1988 | Sakai . |
| 4,796,050 | 1/1989 | Furuta et al. . |
| 4,922,301 | 5/1990 | Katoh et al. . |
| 4,933,727 | 6/1990 | Mizuma et al. . |
| 5,160,969 | 11/1992 | Mizuma et al. . |
| 5,321,475 | 6/1994 | Horiuchi et al. . |
| 5,652,948 | 7/1997 | Sakaguchi et al. ..... 399/66 |

FOREIGN PATENT DOCUMENTS

| | | |
|---|---|---|
| 5-6128 | 1/1993 | Japan . |
| 5-303288 | 11/1993 | Japan . |
| 6-308798 | 11/1994 | Japan . |
| 7-72743 | 3/1995 | Japan . |
| 8194360 | 7/1996 | Japan . |
| 8334953 | 12/1996 | Japan . |

OTHER PUBLICATIONS

Abstract of Japanese publication No. 4–296877, published Oct. 21, 1992.

*Primary Examiner*—Joan Pendegrass
*Attorney, Agent, or Firm*—Cooper & Dunham LLP

[57] ABSTRACT

An image forming apparatus includes an intermediate transfer member which moves in one direction with a surface thereof facing and contacting an image carrier so as to transfer toner images for multiple colors from the image carrier to the intermediate transfer member to form at least one toner image page having the multiple colors superimposed thereon. An image transfer device transfers the toner image page on the intermediate transfer member to a recording medium or sheet, and a cleaning device, which is movable into contact with or away from the intermediate transfer member at predefined times, cleans the intermediate transfer member. The cleaning device is positioned so that a distance from an intermediate transfer nip portion entrance part to the cleaning device in the moving direction of the intermediate transfer member is greater than a length of the intermediate transfer member occupied by one or more toner image pages and a distance from the intermediate transfer nip entrance part to an intermediate transfer nip exit part.

8 Claims, 7 Drawing Sheets

IMAGE FORMING APPARATUS CLEANING AN INTERMEDIATE TRANSFER MEMBER CARRYING A CONCURRENTLY EXISTING PLURALITY OF TONER IMAGE PAGES

BACKGROUND

1. Field of the Invention

The present invention relates to an image forming apparatus adapted for copiers, facsimiles, printers and the like, and more particularly to color image forming apparatus that use an intermediate transfer member to transfer toner images to a recording medium.

2. Description of the Related Art

Conventionally, in the field of image forming apparatus implementing an intermediate transfer member, such as an intermediate transfer belt, the intermediate transfer member moves in one direction with a surface thereof facing and contacting an image carrier. Toner images sequentially formed on the image carrier are then transferred from the image carrier to the intermediate transfer member superimposing one upon the other. The superimposed toner images are then transferred to a recording medium, such as a paper sheet. After the superimposed toner images are transferred to the recording medium, the surface of the intermediate transfer member is cleaned by a cleaning device mounted adjacent the intermediate transfer member to prevent contamination of subsequent images to be formed thereupon.

Also, there has been known an image forming apparatus, in which a plurality of pages of superimposed toner images are formed on the intermediate transfer member when the size of an original image is small, such that through-put of the apparatus (the number of prints per unit time) increases.

In such an image forming apparatus, in which toner images sequentially formed on the image carrier are transferred to an intermediate transfer belt one upon the other, the transferred toner images may be damaged if a given ratio of linear velocity of the image carrier and the intermediate transfer belt changes during the transfer of toner images from the image carrier to the intermediate transfer belt (hereinafter such a transfer is referred to as a belt transfer). For example, the transferred toner images may blur, or a lateral white stripe where no toner is transferred may be formed on the transferred toner images.

Generally, such a change in the ratio of the linear velocity of the image carrier and the intermediate transfer belt may be caused by sudden load changes on the driving system of the image carrier and/or the intermediate transfer belt. Such load changes often occur when a cleaning device used to clean the belt, such as a rubber blade, contacts or separates from the intermediate transfer belt.

To avoid damaging transferred toner images during a belt transfer, it is desirable to clean the intermediate transfer belt when the belt transfer process is not being performed. In other words, the belt transfer is not performed when the cleaning process is being performed. However, this decreases through-put (the number of prints per unit time) of the apparatus when images are continuously formed, because a belt transfer for a next print is not started until the cleaning process of the intermediate transfer belt for the preceding print is completed.

Therefore, a need exists for an improved image forming apparatus that times the cleaning process for the intermediate transfer member with the belt transfer process to maximize through-put when continuously forming images while avoiding toner image damage or deterioration when transferring toner images from an image carrier to an intermediate transfer member.

SUMMARY

The present application provides an image forming apparatus that times the cleaning process for an intermediate transfer member with a belt transfer process to maximize through-put when continuously forming images while avoiding toner image damage or deterioration when transferring toner images from an image carrier to the intermediate transfer member.

One embodiment of the image forming apparatus according to the present application includes an image carrier, a toner image forming device which sequentially forms toner images on the image carrier, an intermediate transfer member which moves to one direction with a surface thereof facing the image carrier. An intermediate transfer device presses at least a portion of the intermediate transfer member to contact the image carrier and sequentially transfers the toner images from the image carrier to the intermediate transfer member one upon the other to form a superimposed toner images page, and an image transfer device transfers the superimposed toner images page (hereinafter a toner image page) on the intermediate transfer member to a recording medium. A cleaning device which is movable into contact with or away from the intermediate transfer member and which contacts the intermediate transfer member at a prescribed timing to clean the intermediate transfer member is used to remove residual toner from the intermediate transfer member after the toner image page is transferred to the recording medium.

The cleaning device is disposed at a position relative to an intermediate transfer nip portion entrance part such that a distance from the nip entrance part to the cleaning device along a moving direction of the intermediate transfer member is greater than a length of the intermediate transfer member occupied by one or more toner image pages and a distance from the intermediate transfer nip portion entrance part to an intermediate transfer nip portion exit part in the moving direction of the intermediate transfer member.

The image forming apparatus may also include a controller which controls the cleaning device when a single toner image page or a plurality of toner image pages are continuously formed on the intermediate transfer member. The controller controls movement of the cleaning device so that the cleaning device is brought into contact with the intermediate transfer member after the single toner image page or plurality of toner image pages are formed on the intermediate transfer member, and before an area of the intermediate transfer member occupied by a leading edge of either the single toner image page or a first toner image page of the plurality of toner image pages reaches a cleaning device. The controller also controls movement of the cleaning unit so that the cleaning unit is separated from the intermediate transfer member after a first toner image for a next single toner image page, or a first toner image for a last of a plurality of next toner image pages are transferred to the intermediate transfer member, and before a leading edge of the first toner image for the next single toner image page or the first toner image for a first of the plurality of next toner image pages on the intermediate transfer member reaches the cleaning device.

BRIEF DESCRIPTION OF THE DRAWINGS

A more complete appreciation of the present application and many of the attendant advantages thereof will be readily obtained by reference to the following detailed description when considered in connection with the accompanying drawings, wherein.

DETAILED DESCRIPTION

Figure 1:
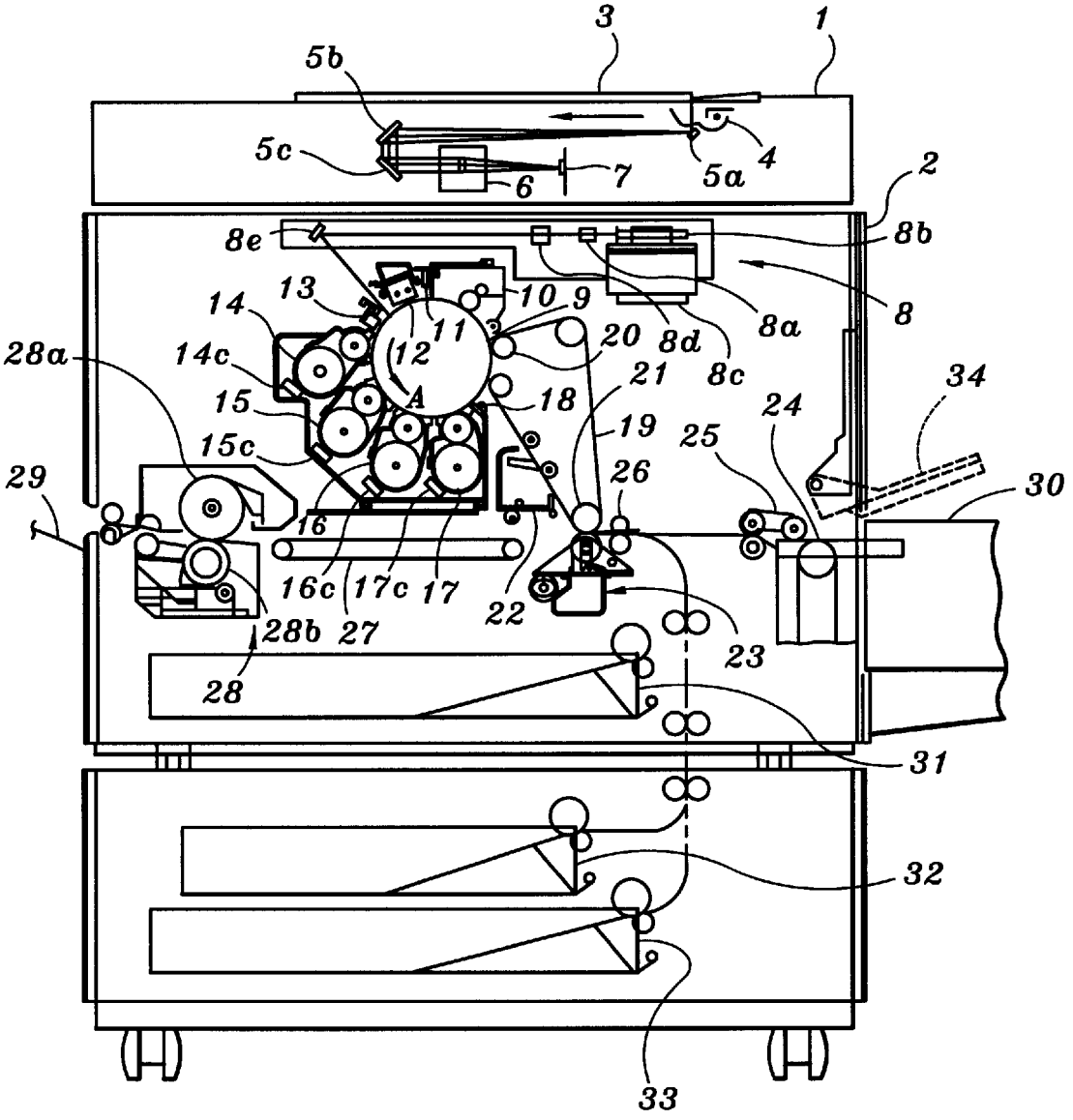
FIG. 1 is a schematic diagram showing an exemplary structure of a color image forming apparatus according to the present application.

Referring now to the drawings, wherein like reference numerals designate identical or corresponding parts throughout the several views, embodiments of the present application are explained herein below. In FIG. 1, the color image forming apparatus according to the present application includes a color image reading unit (hereinafter referred to as a color scanner) 1 and a color image recording unit (hereinafter referred to as a color printer) 2. The color scanner 1 lights an original document 3 with a lamp 4 to read images on the original document 3. Light reflected from a surface of the original document 3 is received by a color sensor 7 via a group of mirrors and lenses, including mirrors 5*a*, 5*b*, 5*c* and lens 6. The color sensor 7 includes a color separating device and an optic-to-electric conversion device, such as a CCD (charged-coupled device). The color sensor 7 separates the received full-color image into red, green and blue components (also referred to as RGB components) and then converts each RGB component to corresponding electrical image signals. The color sensor 7 reads the full-color image at the same time.

An image processor then coverts the RGB image signals to color image data for cyan, magenta, yellow and black (CMYK) color image components. Color image data for each CMYK color image component is later developed by the color printer 2 using CMYK toners and the developed toner images (hereinafter toner images) are superimposed to form a toner image page.

To develop toner images, an optical writing unit 8 of the color printer 2 converts color image data for each CMYK color image component to an optical signal which is used to form a latent image on an image carrier, preferably a drum-shaped photoconductor 9, which corresponds to the original images. The optical writing unit 8 includes a laser light source 8*a*, a driving unit (not shown) for irradiating the laser light source 8*a*, a polygon mirror 8*b*, a driving motor 8*c* for rotating the polygon mirror 8*b*, a f-θ lens 8*d*, and a reflecting mirror 8*e*.

The photoconductor 9 rotates in the counterclockwise direction as indicated by arrow A, and various other components used to form a toner image from the latent image are arranged around the photoconductor 9. For example, a photoconductor cleaning unit 10 (including a pre-cleaning discharging unit), a discharging lamp 11, a charging unit 12, and a charge sensor 13 are positioned around the photoconductor. A black toner developing unit 14, a cyan toner developing unit 15, a magenta toner developing unit 16, a yellow toner developing unit 17, and an optical sensor 18 for detecting a pattern for detecting developing density are also positioned around the photoconductor 9 at points sufficient to develop a latent image on the photoconductor to form a toner image but before the toner image is transferred onto an intermediate transfer member 19 that engages the photoconductor at an area identified as a intermediate transfer nip portion. The intermediate transfer member 19 may be a belt or other suitable medium for carrying toner images and transferring the toner images to a recording medium.

Figure 2:
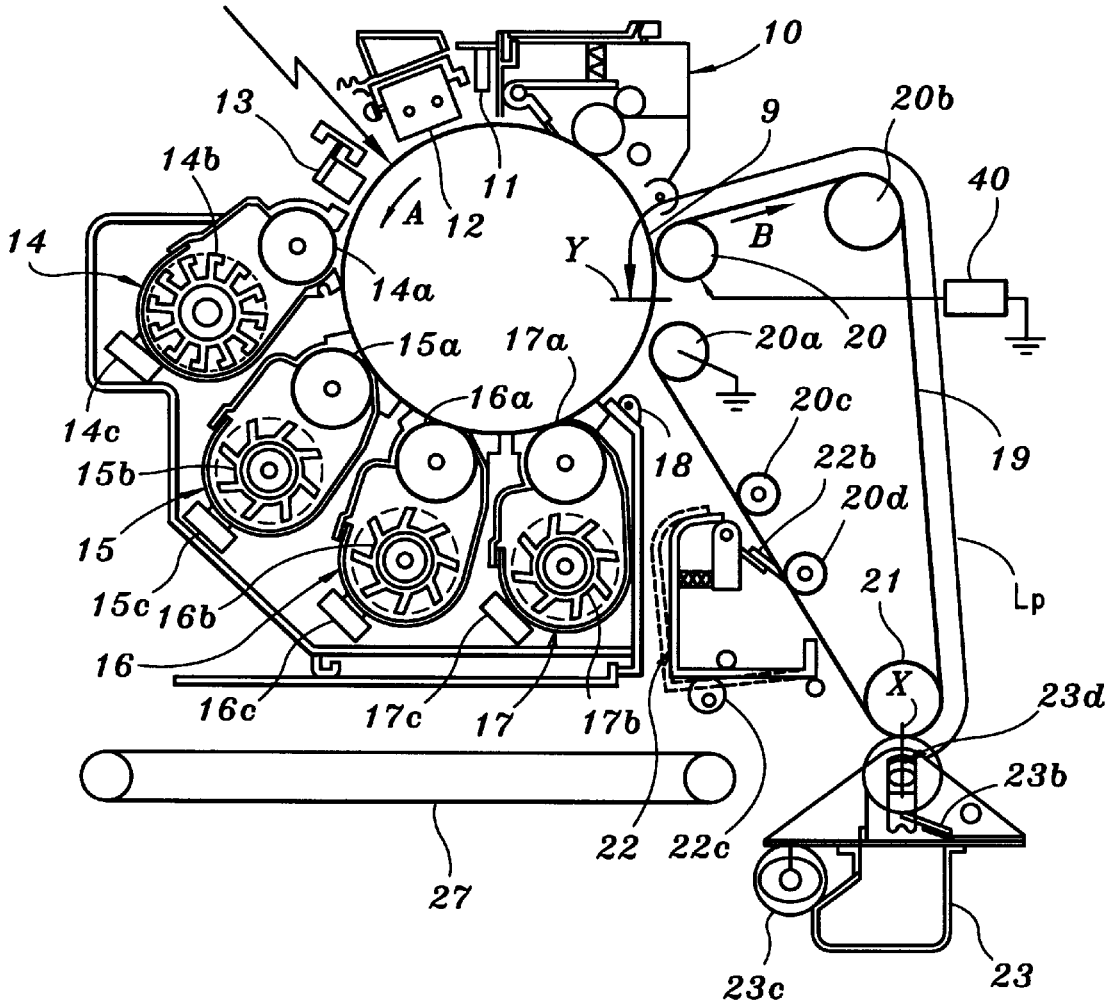
FIG. 2 is a schematic diagram of an image forming portion of the apparatus shown in FIG. 1.

Referring to FIGS. 1 and 2, the developing units 14, 15, 16 and 17 include developing sleeves 14*a*, 15*a*, 16*a* and 17*a* each of which rotates so that a sleeve or ear of developer, which includes toner and carrier, is formed and contacts the surface of the photoconductor 9 to develop the latent images on the photoconductor 9 with toner to form a toner image. The developing units 14, 15, 16, and 17 also include developer paddles 14*b*, 15*b*, 16*b* and 17*b* to scoop up and agitate the developer, and toner density sensors 14*c*, 15*c*, 16*c* and 17*c* that detect the density of the toner in the developer.

Continuing to refer to FIG. 2, the intermediate transfer belt 19 is spanned around a drive roller 21, a transfer bias roller 20 and a series of supporting rollers (e.g., rollers 20*a*, 20*b*, 20*c*, and 20*d*). The intermediate transfer belt 19 is pressed against the photoconductor 9 at the intermediate transfer nip portion defined by the area between the transfer bias roller 20 and supporting roller 20*a*. To transfer a toner image to the belt 19, the rollers 20 and 20*a* apply an appropriate pressing force so that the intermediate transfer belt 19 contacts the photoconductor 9, and a transfer bias electric source 40 selectively applies a predefined bias voltage to the transfer bias roller 20. A drive motor (not shown) is connected to the drive roller 21 which moves the intermediate transfer belt 19 in the direction of arrow B.

An intermediate transfer device according to the present application used for transferring toner images from the photoconductor 9 to the intermediate transfer belt 19 includes the transfer bias roller 20 and the transfer bias electric source 40.

The apparatus of the present application also includes a belt cleaning unit 22. The belt cleaning unit 22 includes a cleaning device, such as rubber blade 22*b*, that is used to remove residual toner from the belt 19, and a contact/separation device 22*c* used to move at least the blade 22*b* toward the intermediate transfer belt 19 to a position where the blade engages a surface of the belt and to move the blade away from the intermediate transfer belt 19. A relationship of the timing for moving the cleaning unit blade 22*b* into contact with and away from the surface of the intermediate transfer belt 19 will be explained later.

A sheet transfer unit 23 is used as an image transfer device for transferring toner image pages on the intermediate transfer belt 19 to a recording medium (or sheet) 24. The sheet transfer unit includes a sheet transfer bias roller 23*a*, a roller cleaning blade 23*b* and a contact/separation device 23*c* that moves the sheet transfer unit 23 toward and away from the intermediate transfer belt 19. The sheet transfer bias roller 23*a* is separated from the transfer surface of the intermediate transfer belt 19 except when transferring a toner image page formed on the intermediate transfer belt 19 to the recording medium 24. When transferring a toner image page to a sheet 24, the sheet transfer bias roller 23*a* is pressed against the intermediate transfer belt 19 at a time after one or more toner image pages are formed on the belt using the contact/separation device 23*c*. A predefined bias voltage is applied to the roller 23*a* to transfer each toner image page to the transfer sheet 24.

As shown in FIG. 1, for manual sheet feeding, the sheet 24 is fed from a manual feed tray 34 to a feed roller 25 and a registration roller 26, and is conveyed into a sheet transfer part between the drive roller 21 and the sheet transfer bias roller 23*a* (FIG. 2) by the time the leading edge of a toner image page on the intermediate transfer belt 19 reaches the sheet transfer part where the toner image page is then transferred to the sheet 24. After the transfer, the sheet 24 is conveyed by a conveying belt 27 to a fixing unit 28, where the transferred toner image page is fixed to the sheet 24 by, for example, a fixing roller 28*a* heated to a predefined temperature and a pressure roller 28*b*. After fixing, the sheet 24 exits to an exit tray 29.

For automatic sheet feeding, recording medium cassettes 30, 31, 32 and 33 respectively accommodate recording mediums (or sheets) of different sizes. A desired size for the sheet 24 is selected by an operator via an operation panel, and the sheet 24 of a selected size is fed out from a corresponding cassette towards the registration roller 26 at a given timing.

Figure 3:
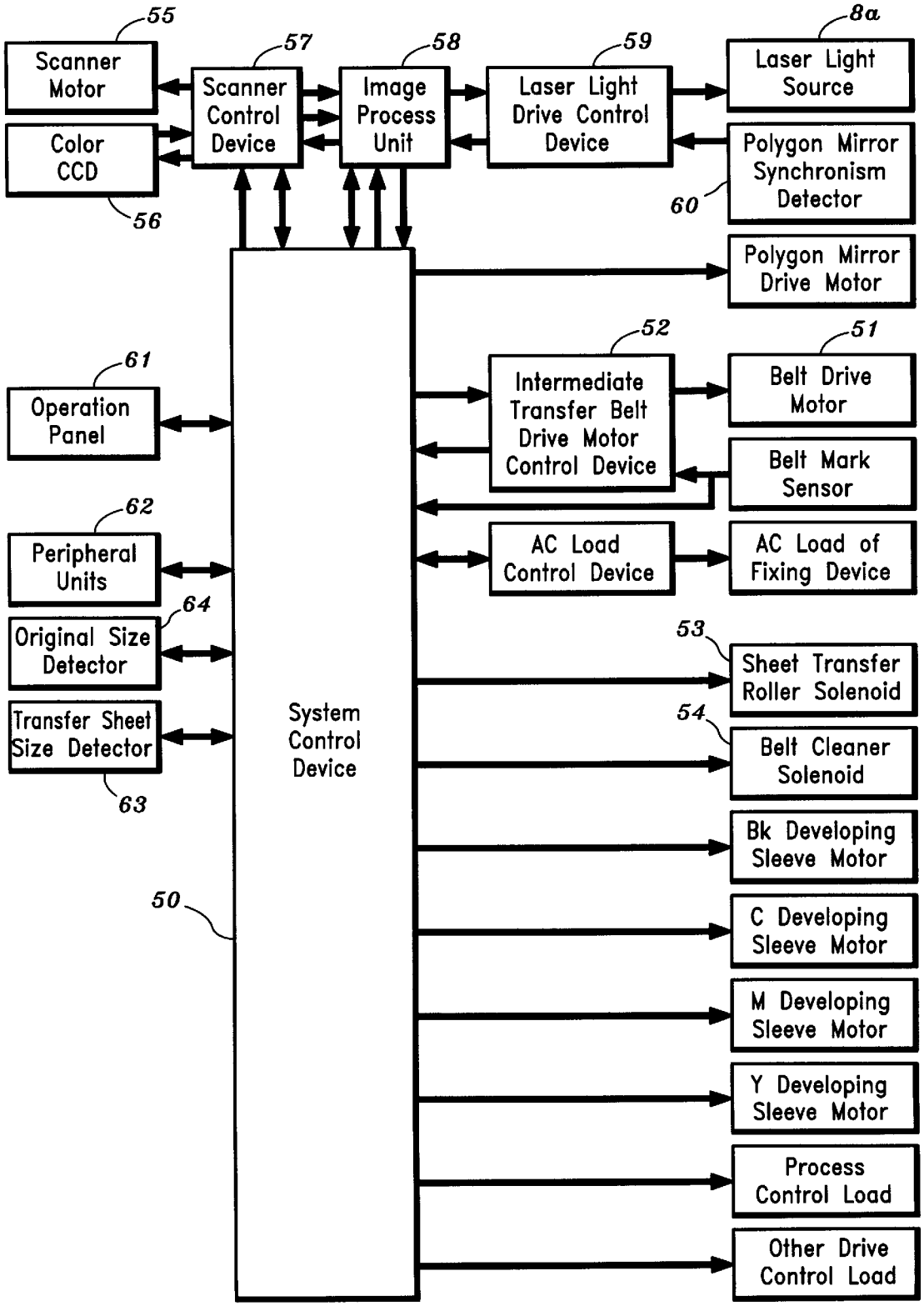
FIG. 3 is a block diagram of an exemplary embodiment of a control system for the apparatus of FIG. 1.

Referring now to FIG. 3, an exemplary control system in the color image forming apparatus includes a system control device 50 having a CPU (central processing unit), memory (e.g., RAM and ROM), stored programs (e.g., system and application), I/O interface circuitry and associated circuitry used to control the various processes and functions of the apparatus. As shown in FIG. 3, a scanner control device 57 is connected to the system control device 50 and provides controls signals to the CCD 56 and a scanner motor 55 for the color scanner 1. An image processing unit 58 is connected to the system control device and the scanner control device and provides control signals to a laser control device 59 that controls the laser light source 8*a* and a detect device 60 that detects synchronism of the polygon mirror 8*b*.

In addition, a motor for rotating the polygon mirror 8*b*, an operation panel 61, peripheral units 62, such as an automatic document feeder (ADF), and sheet size detecting devices, such as a sheet size detector 63 and an original document size detector 64, are connected to the system control device 50.

Referring to FIGS. 2 and 3, the control device 50 is connected to an intermediate transfer member control device 52 and provides control signals to an intermediate transfer member drive unit 51. As noted, the intermediate transfer member 19 is preferably a belt so that the intermediate transfer member drive unit 51 is preferably a belt drive motor. The belt drive motor 51 is used to rotate the drive roller 21 which moves the intermediate transfer belt 19 in the direct of arrow B.

To transfer a toner image page on the belt onto the recording medium 24, a sheet transfer roller solenoid 53 is activated by the system control device 50 which moves a transfer roller 23*a* toward the belt 19. As portions of the toner image page are transferred and the belt continues to move, a belt cleaner solenoid is activated so that the cleaning unit blade 22*b* contacts the surface of the intermediate transfer belt 19 and removes residual toner from the belt.

To increase the through-put of the apparatus when continuously forming (or copying) an original image of small size, multiple toner image pages are formed on the intermediate transfer belt 19. More particularly, when the image forming apparatus described above is used to continuously form images of an original image of the original document 3 (i.e., make multiple copies of an original document), the apparatus is capable of changing the number of toner image pages to be formed on the intermediate transfer belt 19 depending upon the size of the original image. For example, when the length of an original document defined in the moving direction of the intermediate transfer belt 19 is smaller than one half of the circumferential length of the intermediate transfer belt 19, the apparatus can operate in a mode where a plurality of toner image pages can be formed on the intermediate transfer belt 19.

Figure 4:
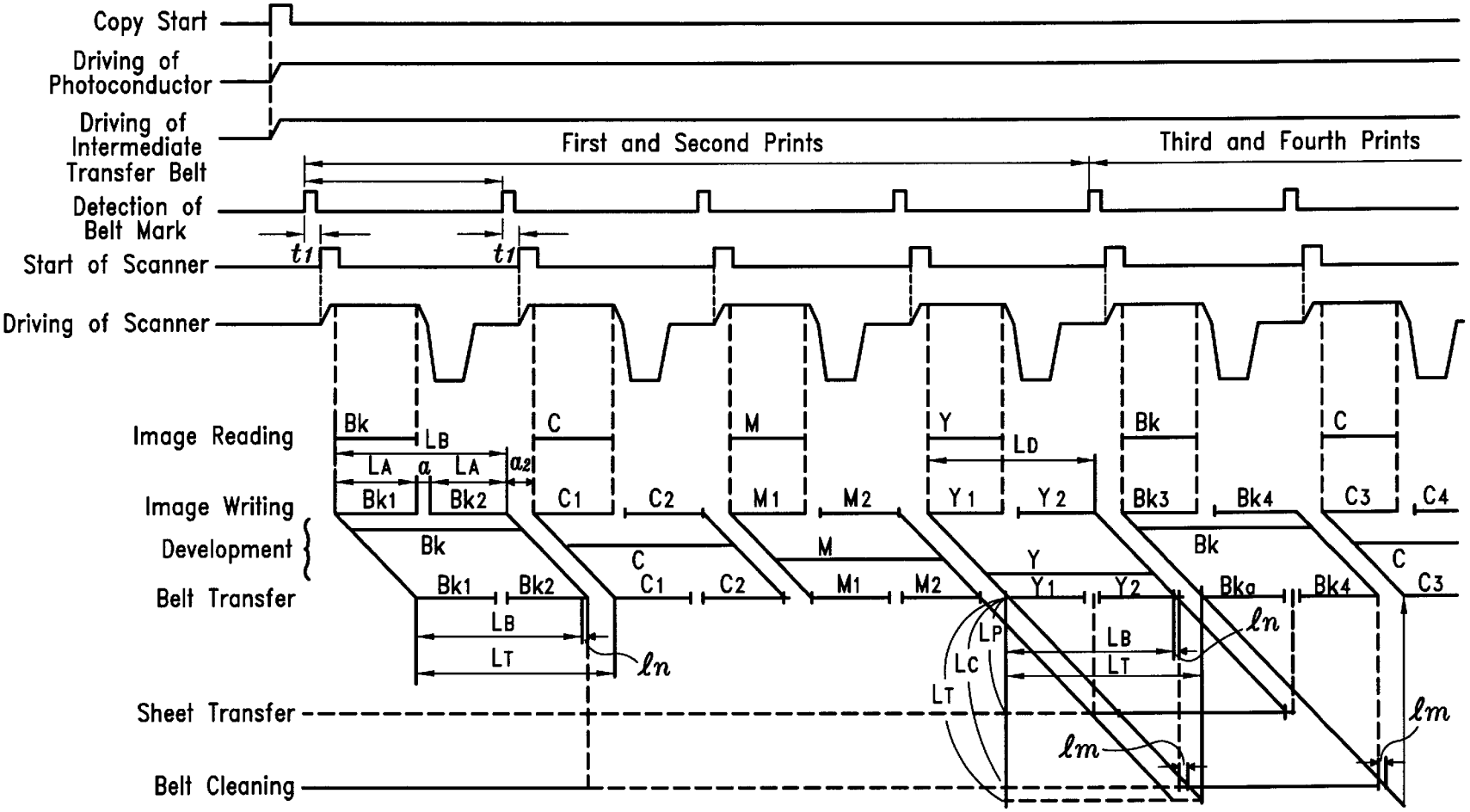
FIG. 4 is a timing diagram for forming images on a recording medium with the apparatus of FIG. 1, illustrating a timing relationship of belt transfer and belt cleaning processes of the apparatus when forming multiple pages of superimposed toner images on an intermediate transfer member.

An example of this process for forming images where two toner image pages are formed on the intermediate transfer belt 19 will be described with reference to the timing diagram of FIG. 4. For this example, toner images for each toner image page are formed in the order of black, cyan, magenta and yellow. However, the order for forming the toner images is not limited to the order shown in FIG. 4. Further, of the two toner image pages formed, the first formed page is called the first toner image page (P1) and the subsequent toner image page is called the second toner image page (P2).

When an image forming operation is started, the photoconductor 9 is rotated in the counterclockwise direction A (FIGS. 1 and 2) and the surface of the photoconductor 9 is uniformly charged by the charging unit 12. Simultaneously, the belt drive motor 51 (FIG. 3) is activated and the intermediate transfer belt 19 begins moving in the direction indicated by arrow B (FIG. 2) via drive roller 21. The belt 19 includes a position information mark (or indicia) which is provided as a reference mark for aligning leading edges of the toner images when superimposing the toner images onto the belt. When the position information mark is detected by a belt mark sensor, the color scanner 1 starts reading black toner image data for the first toner image page.

To increase copy throughput, when the image data for forming a toner image for the first toner image page is read, the same color image data is stored in a frame memory of the system control device 50 and is used as the image data for the same color toner image for the second toner image page. Thus, for example, when black image data is read for the black toner image of the first toner image page, the same black image data is stored in the frame memory and is used as black image data for the black toner image of the second toner image page.

Then optical writing is performed by the optical unit 8 in accordance with the black image data to form a black latent image for the first toner image page on the photoconductor 9. Hereinafter, a black latent image for the first toner image page is called a Bk1 latent image. Likewise, latent images formed in accordance with cyan, magenta and yellow image data for the first toner image page are called a C1 latent image, an M1 latent image and a Y1 latent image, respectively. Similarly, latent images formed in accordance with black, cyan, magenta and yellow image data for the second toner image page is called a Bk2 latent image, a C2 latent image, an M2 latent image and a Y2 latent image, respectively.

Before the leading edge of the Bk1 latent image reaches a developing position of the black developing unit 14, the developing sleeve 14*a* starts to rotate to form a developer sleeve or ear used to develop the Bk1 latent image and form a black toner image.

The black toner image for the first toner image page (hereinafter called a Bk1 toner image) is formed as the Bk1 latent image passes the ear of developer. The Bk1 toner image is then transferred to the surface of the intermediate transfer belt 19 which is rotating at substantially the same linear velocity as the photoconductor 9. Transfer of a toner image from the photoconductor 9 to the intermediate transfer belt 19 is called belt transfer as discussed earlier. Belt transfer is performed by applying a given bias voltage to the transfer bias roller 20*a* when the toner image on the photoconductor 9 passes through the intermediate transfer nip portion.

Optical writing for the second toner image page starts at a time such that a leading edge of a Bk2 latent image for the second toner image page is formed on the photoconductor 9 a distance a1 from the trailing edge of the Bk1 latent image. The Bk2 latent image is formed from image data stored in the frame memory. The distance a1 corresponds to a distance between sheets 24 (FIG. 1) which are fed by rollers 25 and 26 to transfer a plurality of toner image pages. Black toner image for the second toner image page (hereinafter called a Bk2 toner image) is then formed as the Bk2 latent image passes the ear of developer. The Bk2 toner image is then transferred to the surface of the intermediate transfer belt 19 so that the Bk2 toner image is at a distance a1 from the trailing edge of the Bk1 toner image.

After belt transfer, the surface of the photoconductor 9 is cleaned by the photoconductor cleaning unit 10 and is discharged by the discharge lamp 11 for subsequent latent image formation.

The developer sleeve or ear continues to be formed until the trailing edge of the Bk2 latent image passes the black developing position. As soon as the trailing edge of the Bk2 latent image passes the developing position, formation of the developer sleeve or ear on the black developing sleeve 14*a* is discontinued, by for example reversing the rotating direction of the developing sleeve 14*a*, and the developing operation of the black developing unit 14 is terminated. Stoppage of the developing operation by the black developing unit 14 is completed before the leading edge of the next latent image, here a C1 latent image, reaches the developing position of the black developing unit 14.

This process is repeated for each color (CMY) so that black, cyan, magenta and yellow toner images are sequentially transferred one upon the other to the intermediate transfer belt 19 in the same order as they are formed on the photoconductor 9 and aligned to the proper toner image page to form two toner image pages on the intermediate transfer belt 19. The two toner image pages are then transferred to a sheet 24 one at a time. Transfer of a toner image page from the intermediate transfer belt to the recording medium is called sheet transfer. Sheet transfers of the first and second toner image pages are called print 1 and print 2, respectively and sheet transfers of a next set of first and second toner image pages are called print 3 and print 4, respectively.

After the toner image page is transferred to a sheet, residual toner and other debris from the page are removed from the intermediate transfer belt by the belt cleaning unit 22 for subsequent belt transfer.

A control process for moving the intermediate transfer belt 19 after belt transfer of a first color toner image (i.e., a Bk toner image) is completed, is described. The control process may be implemented using various methods including a constant velocity method and a skip method. The example of the image forming apparatus shown in the drawings employs the constant velocity method for controlling movement of the intermediate transfer belt 19.

In the constant velocity method, after belt transfer of a Bk toner image or images is completed, the intermediate transfer belt 19 is continued to be driven at substantially the same linear velocity as before the belt transfer. The color scanner 1 forms a C latent image on the photoconductor 9 at a timing such that the leading edge of the C toner image on the photoconductor 9 reaches the intermediate transfer nip portion when the leading edge of the Bk toner image on the intermediate transfer belt 19 reaches the intermediate transfer nip portion. Accordingly, the C toner image on the photoconductor 9 is transferred to the intermediate transfer belt 19 in correct alignment with and superimposed upon the Bk toner image. Substantially the same processes are performed for M and Y toner images so that superimposed toner images in four colors are formed on the intermediate transfer belt 19. The intermediate transfer belt 19 continues to be driven at the same linear velocity after belt transfer for the Y toner image and through transfer of the toner image page to the sheet 24.

In the skip method, after belt transfer of a Bk toner image or images is completed, the intermediate transfer belt 19 is separated from the photoconductor 9 so that the intermediate transfer belt 19 can be driven at a faster linear velocity. This method further enhances the through-put of the apparatus. After the belt 19 is driven a given distance at the faster liner velocity, the velocity of the belt 19 is returned to the previous velocity and then the intermediate transfer belt 19 is moved to contact the photoconductor 9 at the intermediate transfer nip portion. The color scanner 1 then forms a C latent image on the photoconductor 9 at a time such that the leading edge of a C toner image on the photoconductor 9 reaches the intermediate transfer nip portion when the leading edge of the Bk toner image on the intermediate transfer belt 19 reaches the intermediate transfer nip portion. Substantially the same process is performed for M and Y toner images so that superimposed toner images in four colors are formed on the intermediate transfer belt 19. The intermediate transfer belt 19 continues to be driven at the same linear velocity after belt transfer for the Y toner image and through transfer of the toner image page to the sheet 24.

Alternatively, the above-described two methods may be combined such that, for example, when the size of an original image is smaller than one half of the circumferential length of the intermediate transfer belt 19, the intermediate transfer belt 19 is controlled by the constant velocity method when toner image pages are continuously formed (i,e., when making multiple copies of the original image), and the belt 19 is controlled by the skip method when toner image pages are not continuously formed (i.e., when making a single copy of the original image).

Referring again to FIG. 4, the process of continuously forming images of an original document according to the present application will now be described. After the image forming apparatus performs the process of forming toner images for the last color, e.g., a yellow image, for the first and second toner image pages (defining, for example, first and second prints or copies), the leading edge of the first toner image page on the intermediate transfer belt 19 reaches the sheet transfer part at point X after the intermediate transfer belt 19 travels a distance Lp (FIG. 2) from the intermediate transfer nip portion at point Y.

The sheet transfer unit 23 is pressed by the contact/separation device 23*c* against the intermediate transfer belt 19 before the leading edge of the first toner image page on the intermediate transfer belt 19 reaches the sheet transfer part at a point X and after the trailing edge of an M2 toner image for the second toner image page passes the sheet transfer part and when a gap between the trailing edge of the Y1 toner image and the leading edge of the Y2 toner image is positioned within the intermediate transfer nip portion.

The sheet transfer unit 23 is separated from the intermediate transfer belt 19 by the contact/separation unit 23*c* after the second toner image page on the intermediate transfer belt 19 is transferred to the sheet 24 and before the leading edge of a Bk toner image for a third print (hereinafter called a Bk3 toner image) reaches the sheet transfer part and when a gap between the trailing edge of the Bk3 toner image and the leading edge of a Bk toner image for a fourth print (hereinafter called a Bk4 toner image) is positioned within the intermediate transfer nip portion.

Figure 5A:
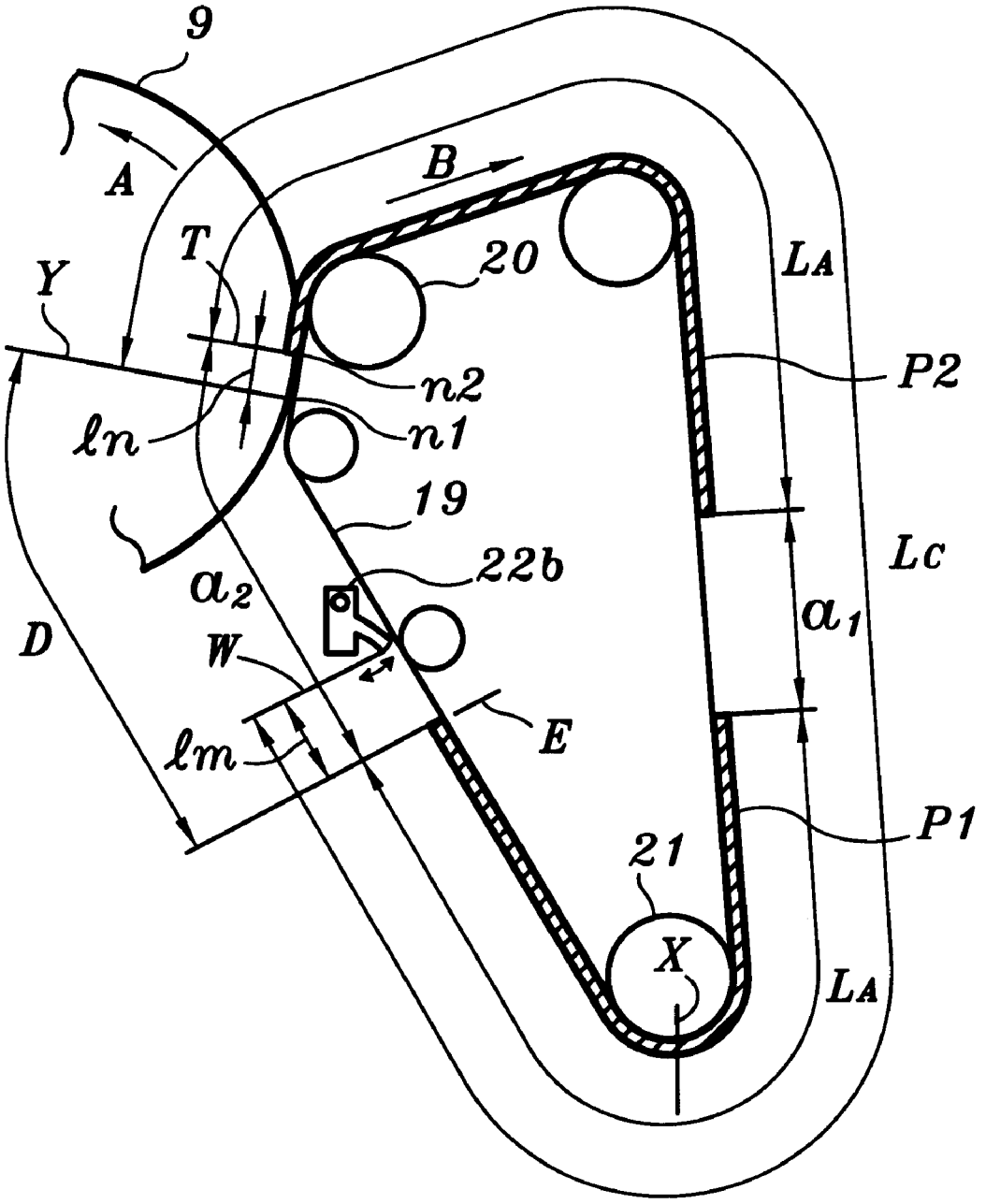
FIG. 5A is a schematic diagram of an image transfer portion of the apparatus for explaining a relationship between belt transfer and belt cleaning processes for the apparatus of the present application when transferring multiple pages of superimposed toner images onto an intermediate transfer member.
Figure 5B:
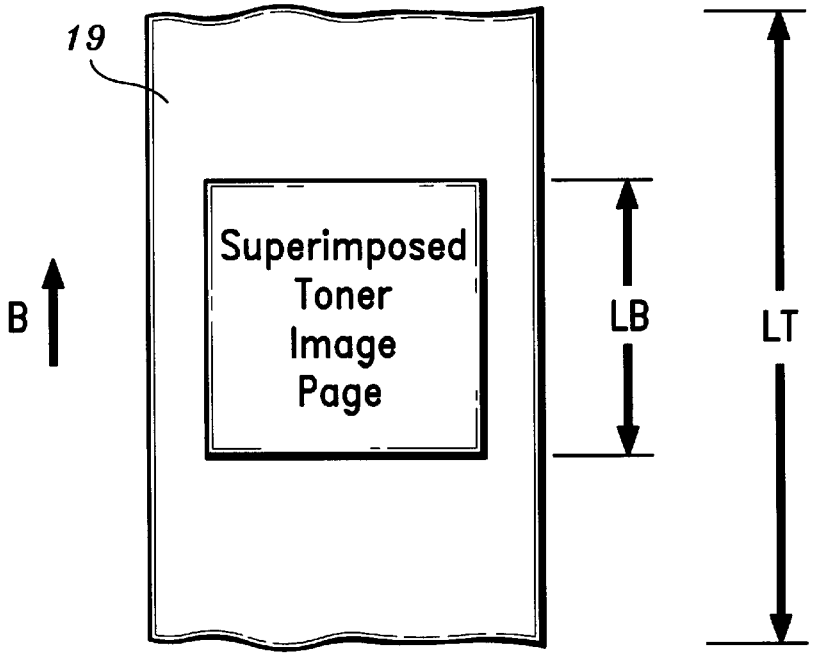
FIGS. 5B and 5C are schematic diagrams illustrating the relationship between an area occupied by one or more toner image pages on an intermediate transfer member and the length of the intermediate transfer member.
Figure 5C:
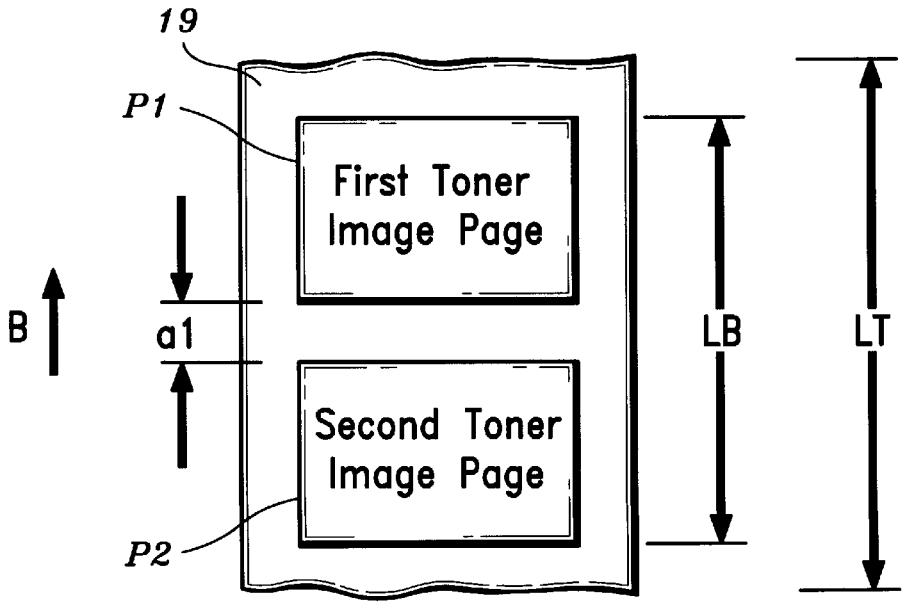

Next, the operation of the belt cleaning unit 22 when images are continuously formed is explained with reference to FIGS. 4 and 5A, 5B, and 5C. FIG. 5A shows a relationship between the time the cleaning unit blade 22*b* engages the intermediate transfer belt 19 relative to the leading edge of a first toner image page when two toner image pages are formed on the belt 19. In FIG. 5A, a distance LC represents a distance the belt 19 travels when moving from an entrance part n1 of the intermediate transfer nip portion to a point W associated with an area where the cleaning unit blade 22*b* contacts the intermediate transfer belt. Preferably, LC is greater than the sum of: 1) a length LB (FIGS. 5B and 5C) which is the length of the belt occupied by one or more toner images; and 2) a distance 1*n* (FIG. 5A) from the entrance part n1 of the intermediate transfer nip portion to an exit part n2 of the nip portion. The length LB is the longest of either i) a maximum distance from a leading edge of a single toner image page to a trailing edge of the single toner image page (FIG. 5B), or ii) a maximum distance from a leading edge of a first toner image page to a trailing edge of a last of a plurality of pages of toner image pages formed on the intermediate transfer belt 19 (FIG. 5C). To illustrate, when two toner image pages P1 and P2 are formed on the intermediate transfer belt 19 as shown in FIG. 5A, the length LB is the distance from the leading edge E of the first toner image page P1 to the trailing edge T of the second toner image page P2. If the length of each toner image page is represented as LA and a distance between the pages a1, the length LB is LA+a1+LA. The distance a1 is determined based upon the speed at which sheet 24 is conveyed to the sheet transfer part.

Thus, when the circumferential length of the intermediate transfer belt 19 is represented as LT, the cleaning unit 22 is located in an area D defined by a distance between the entrance part n1 of the intermediate transfer nip portion and the leading edge E of toner image page P1 after the toner image P1 is moved on the intermediate transfer belt 19 at least to a point that is greater than the sum of the length LB and the distance 1*n* but which is smaller than the length LT.

In the example shown in FIG. 5A, the cleaning unit blade 22*b* is placed in a position in area D where the distance LC is equal to the sum of the distance LB, the distance 1*n* and a distance 1*m*. The distance 1*m* represents a distance between the leading edge E of toner image page P1 and the point W where the cleaning unit blade 22*b* contacts the belt 19. It should be noted that the first toner image page P1 is illustrated having a uniform thickness after the sheet transfer part. However, the portion of the first toner image page P1 that has passed the sheet transfer part has been transferred to a sheet 24 so that residual toner remains on the intermediate transfer belt 19 after that point.

In the above-described configuration, the leading edge E of the toner image page P1 does not reach the point W until after the belt transfer of the last color toner image (e.g., the Y2 toner image) for the second toner image page P2 is completed and the trailing edge T of the second toner image page P2 passes the exit part n2 of the intermediate transfer nip portion. Two advantages are achieved by this configuration. First, image blurring that may occur when the cleaning unit blade 22*b* contacts the belt 19 is avoided, because the cleaning unit blade 22*b* is brought into contact with the belt 19 immediately after the trailing edge T of the second toner image page P2 passes the exit part n2 of the intermediate transfer nip portion. Second, the cleaning process starts when the leading edge E of the first toner image page P1 on the intermediate transfer belt 19 is a distance 1*m* from the point W where the cleaning unit blade 22*b* contacts the belt.

The cleaning unit blade 22*b* is separated from the intermediate transfer belt 19 after the trailing edge T of the second toner image page passes the cleaning unit blade 22*b* but before the leading edge of a Bk3 toner image of a first toner image page of a third print reaches the cleaning unit blade 22*b*. At this timing, the leading edge of the Bk3 toner image is positioned at the distance 1*m* before the cleaning unit blade 22*b*. As a result, belt transfer of subsequent toner images, e.g., the black toner images, is not affected by the separating movement of the cleaning unit blade 22*b* from the intermediate transfer belt 19. In addition, the cleaning unit blade 22*b* is separated from the intermediate transfer belt 19 when the leading edge of the first subsequent toner image page on the intermediate transfer belt 19 reaches a position at a distance 1*m* from the cleaning unit blade.

When the blade 22*b* of the cleaning unit 22 contacts the intermediate transfer belt 19, instances may occur in which residual toner adhered on the edge of the blade 22*b* is transferred to the intermediate transfer belt 19 and forms a lateral stripe of toner on the intermediate transfer belt 19. For example, if the blade 22*b* of the cleaning unit 22 is brought into contact with the intermediate transfer belt 19 at a relatively later time than the timing described above so that the leading edge of the first toner image page reaches a position closer to the cleaning unit blade 22*b* a lateral stripe of toner may be formed in close vicinity to a leading edge of a subsequent toner image being transferred to the belt. Consequently, a lateral stripe of toner may be formed in the vicinity of the leading edge of the toner image page on the intermediate transfer belt 19. If a sheet 24 is then fed at a time earlier than the prescribed timing for transferring the toner image pages on the intermediate transfer belt 19, the lateral stripe of toner may also be transferred to the sheet 24.

If the blade 22*b* of the cleaning unit 22 is brought into contact with the intermediate transfer belt 19 at a later time than in the above example so that a lateral stripe of toner may be formed within the area where the subsequent toner image are transferred from the photoconductor 9, the quality of toner images formed on the intermediate transfer belt 19 and a resulting image formed on the sheet 24 will further deteriorate.

When the blade 22*b* of the cleaning unit 22 separates from the intermediate transfer belt 19, instances may occur where residual toner on an edge of the blade 22*b* is transferred to the intermediate transfer belt 19, and a lateral stripe of toner is formed on the intermediate transfer belt 19. For example, if the cleaning unit blade 22*b* separates from the intermediate transfer belt 19 at a relatively later time after the trailing edge of a Bk2 toner image for a fourth print passes the intermediate transfer nip portion, a lateral stripe of toner may be formed on the belt in close vicinity to the leading edge of a Bk1 toner image for a fifth print causing similar problems as described above.

Further, when the blade 22*b* separates from the intermediate transfer belt 19, toner remaining between the blade 22*b* and the intermediate transfer belt 19 may float and fall on a part of the intermediate transfer belt 19 which reaches near the cleaning part.

Therefore, if the blade 22*b* of the cleaning unit 22 separates from the intermediate transfer belt 19 at a relatively later time after the trailing edge of the Bk2 toner image for the fourth print passes the intermediate transfer nip portion, floated toner may fall on the leading part of a Bk5 toner image for a fifth print on the intermediate transfer belt 19. As a result, the quality of subsequent toner images on the intermediate transfer belt 19 will deteriorate.

The embodiment described above avoids these problems by timing the cleaning of the belt relative to the position of toner images on the belt. Thus, in the above embodiment, the cleaning unit blade 22*b* is configured to contact the intermediate transfer belt 19 immediately after belt transfer of the last toner image, e.g., a Y2 toner image for a second toner image page forming a first print, is completed. Further, the cleaning unit blade separates from the intermediate transfer belt 19 immediately after belt transfer of a first toner image, e.g., a Bk4 toner image, for second toner image page forming a fourth print, is completed. Thus, the belt cleaning process for the intermediate transfer belt 19 is started at a point in time when the position of the leading edge of the first toner image page is at a distance 1*m* from the cleaning unit blade 22*b*, and the belt cleaning process ends when the leading edge of a first subsequent toner image on the belt is at a distance 1*m* from the cleaning unit blade. The distance 1*m* may be determined based upon various factors, such as a linear velocity of the intermediate transfer belt 19, a variation in registering the leading edge of a sheet 24 with the leading edge of toner image pages at the sheet transfer part, a maximum area in which floated toner may fall and so forth.

Figure 6:
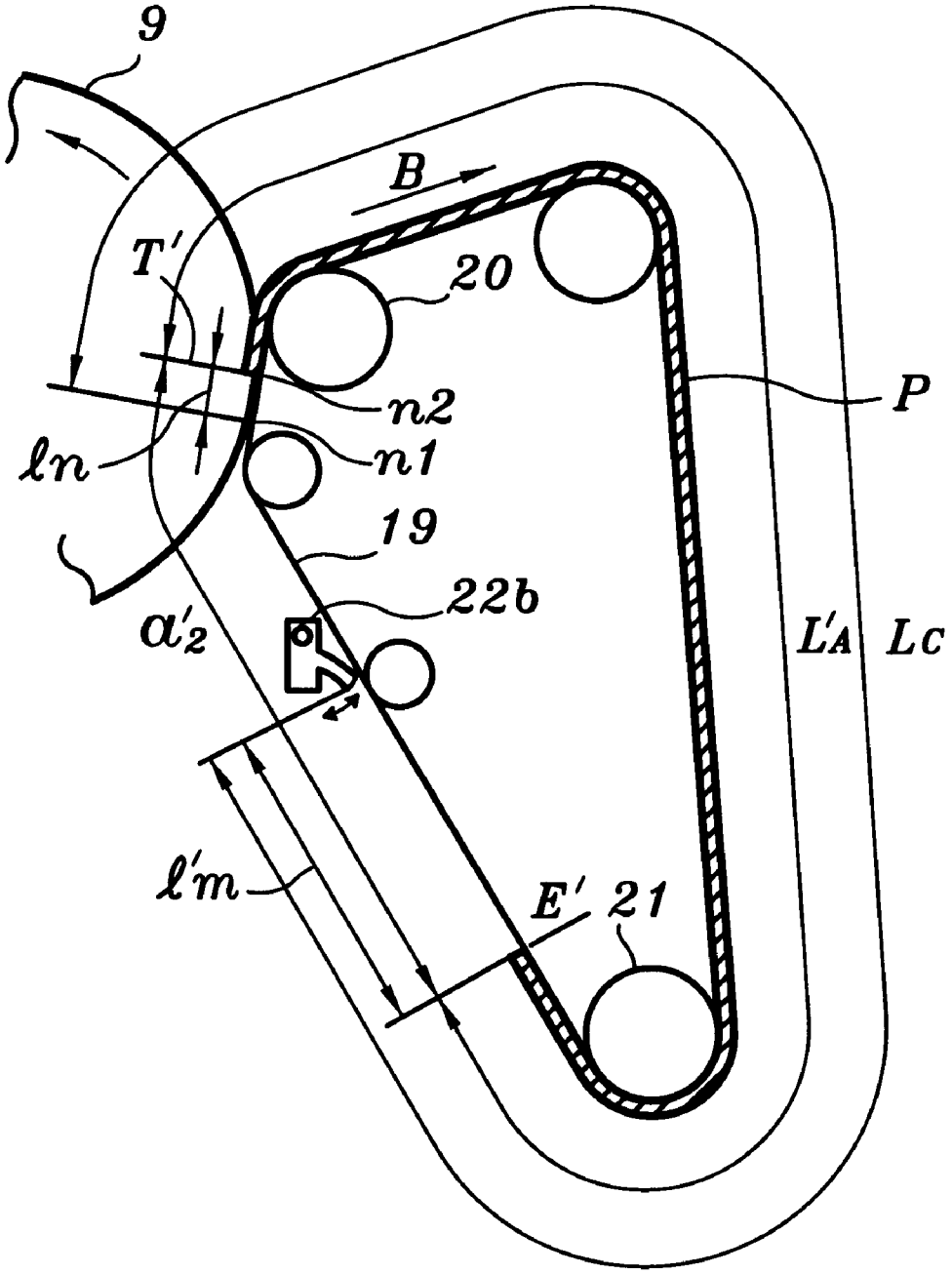
FIG. 6 is a schematic diagram of an image transfer portion of the apparatus for explaining a relationship between belt transfer and belt cleaning processes for the apparatus of the present application when transferring a single page of superimposed toner images on the intermediate transfer member.

Referring now to FIG. 6, a schematic diagram of the image transfer belt and cleaning unit showing a relationship between the time the cleaning unit blade 22*b* engages the intermediate transfer belt 19 relative to the leading edge of a toner image page formed on the belt 19. In this case, the length LB is equal to a length LA' of an original image.

In the image forming apparatus according to this embodiment, the distance LC is greater than the sum of the length LB and the distance 1*n* as described earlier. Therefore, the cleaning unit blade 22*b* can be brought in contact with or separated from the intermediate transfer belt 19 without discontinuing an image forming operation and affecting the belt transfer process of a next toner image formed on the intermediate transfer belt 19. Further, the apparatus shown in FIG. 6 is configured such that the length LA' is smaller than the length LB of the embodiment of FIG. 5. Accordingly, the distance 1*m*' is greater than the distance 1*m*, and consequently a cleaning operation for the intermediate transfer belt 19 can be started or ended with a greater margin than when forming two pages of superimposed toner images on the intermediate transfer belt 19.

When the image forming apparatus described above forms an image in two or three colors, the apparatus performs each process of the image forming operation, such as the optical writing process, the development process or the belt transfer process, the corresponding number of times. For example, when forming an image in two colors, each of the above processes is performed twice.

When images are continuously formed in monochrome, a corresponding developing unit is kept in the state for developing, the intermediate transfer belt 19 continuously moves contacting the photoconductor 9 and the belt cleaning unit blade 22*b* is maintained in contact with the intermediate transfer belt 19 until a designated number of images are formed.

Also, the present application may be applied to an image forming apparatus in which an automatic document feeder (ADF) is employed. The apparatus operates in substantially the same manner as described above except that a page of a plurality of original documents 3 is fed to a prescribed position of the color scanner 1 at a given timing.

Further, if the length of an image on each of a plurality of original documents 3 in the moving direction of the intermediate transfer belt 19 is smaller than one half of the circumferential length of the intermediate transfer belt 19, the plurality of original documents 3 may be fed by the ADF one by one so that superimposed toner images for each original image of each original document are formed on the intermediate transfer belt 19. For example, when forming two toner image pages for two original documents the ADF feeds the first original document and black image data of the first original document is read by the color scanner 1. Then, a Bk1 latent image is formed on the photoconductor 9. The second original document is fed by the ADF onto the prescribed position of the color scanner 1 at a time such that black image data of the second original document is read. Then, a Bk2 latent image is formed on the photoconductor 9. The timing for forming the Bk1 and Bk2 latent images on the photoconductor 9 is such that a distance a1 is between the trailing edge of the Bk1 latent image of the first page and the leading edge of the Bk2 latent image of the second page, as discussed above.

Numerous additional modifications and variations are possible in light of the above teachings. It is therefore to be understood that within the scope of the appended claims, the present invention may be practiced otherwise than as specifically described herein.

This application is based upon Japanese patent application No. 09-012016 filed on Jan. 6, 1997, and the entire contents thereof are incorporated herein by reference.

What is claimed is:

1. A color image forming apparatus, comprising:

an image carrier;

a toner image forming device which sequentially forms toner images on the image carrier;

an intermediate transfer member which moves in a moving direction with a surface thereof facing the image carrier;

an intermediate transfer device which presses at least a portion of the intermediate transfer member to contact the image carrier and which transfers a first set of the toner images from the image carrier to the intermediate transfer member one upon the other to form a first toner image page at a first portion of the intermediate transfer member and a second set of the toner images from the image carrier to the intermediate transfer member one upon the other to form a second toner image page at a second portion of the intermediate transfer member that is spaced from said first portion along the moving direction of the intermediate transfer member, whereby said intermediate transfer member concurrently carries a plurality of toner images spaced from each other along the moving direction of the intermediate transfer member;

an image transfer device which transfers the toner image pages to a recording medium; and a cleaning device which is movable into contact with or away from the intermediate transfer member and which contacts the intermediate transfer member at a prescribed timing to clean the intermediate transfer member; and wherein the portion of the intermediate transfer member that contacts the image carrier defines an intermediate transfer nip portion that includes an intermediate transfer nip entrance part and an intermediate transfer nip exit part, and wherein the cleaning device is disposed at a position relative to the intermediate transfer nip entrance part such that a distance from the intermediate transfer nip entrance part to the cleaning device along the moving direction of the intermediate transfer member is greater than a length of the intermediate transfer member occupied by said plurality of toner image pages plus a length from the intermediate transfer nip entrance part to the intermediate transfer nip exit part in the moving direction of the intermediate transfer member plus a spacing between the toner image pages along the moving direction of said intermediate transfer member.

2. The image forming apparatus according to claim 1, further comprising:

a controller which controls the cleaning device, when successive pluralities of toner image pages are formed on the intermediate transfer member, each of said pluralities including a first and a last toner image page, and each toner image page comprising a first and a last toner image superimposed at a respective common area of said intermediate transfer member, wherein one of said pluralities of toner image pages is formed on the intermediate transfer member before the formation of the next plurality starts, said controller controlling said cleaning device such that the cleaning device is brought into contact with the intermediate transfer member after the last toner image page one of said pluralities of toner image pages is formed on the intermediate transfer member, and before an area of the intermediate transfer member occupied by a leading edge of the first toner image page of the same plurality of toner image pages reaches the cleaning device, and such that the cleaning device is separated from the intermediate transfer member after a first toner image for of the last page of the next plurality of toner image pages is transferred to the intermediate transfer member, and before a leading edge of the first toner image of the next plurality of toner image pages on the intermediate transfer member reaches the cleaning device.

3. The image forming apparatus according to claim 1, further comprising a controller which controls the cleaning device, when successive pluralities of toner image pages are formed on the intermediate transfer member, such that the cleaning device is brought into contact with the intermediate transfer member immediately after the last toner image page of one of said pluralities of toner image pages is formed on the intermediate transfer member, and such that the cleaning device is separated from the intermediate transfer member immediately after a last toner image for the next one of said pluralities of toner image pages is transferred to the intermediate transfer member.

4. An image forming apparatus, comprising:

means for sequentially forming toner images on an image carrier;

an intermediate transfer member which moves to one direction with a surface thereof facing the image carrier;

means for superimposing the toner images from the image carrier to the intermediate transfer member;

means for transferring the superimposed toner images on the intermediate transfer member to a recording medium; and means for cleaning the intermediate transfer member, the cleaning means being movable into contact with or away from the intermediate transfer member and contacting the intermediate transfer member at a prescribed timing to clean the intermediate transfer member; and wherein the cleaning means is disposed at a position relative to an entrance part of an intermediate transfer nip portion such that a distance from the entrance part of the intermediate transfer nip portion to the cleaning means in the moving direction of the intermediate transfer member is greater than a length of the intermediate transfer member occupied by a plurality of toner image pages spaced along the moving direction of the intermediate transfer member plus a length from the entrance part to the exit part of the intermediate transfer nip portion in the moving direction of the intermediate transfer member.

5. The image forming apparatus according to claim 4, further comprising means for controlling the cleaning means when successive pluralities of toner image pages are formed, such that the cleaning means is brought into contact with the intermediate transfer member after one of said pluralities of toner image pages is formed on the intermediate transfer member, and before an area of the intermediate transfer member occupied by a leading edge of the first toner image of the same plurality of toner image pages reaches the cleaning means, and such that the cleaning means is separated from the intermediate transfer member after a plurality of toner images for the next plurality of toner image pages is transferred to the intermediate transfer member and before a leading edge of the first toner image for the next plurality of toner image pages on the intermediate transfer member reaches the cleaning means.

6. The image forming apparatus according to claim 4, further comprising means for controlling the cleaning means when successive pluralities of toner image pages are formed, such that the cleaning means is brought into contact with the intermediate transfer member immediately after one of said pluralities of toner image pages is formed on the intermediate transfer member, and such that the cleaning means is separated from the intermediate transfer member immediately after the last toner image for the next plurality of toner image pages is transferred to the intermediate transfer member.

7. A method of forming color images comprising the steps of:

forming a respective toner image at an image carrier in each of a succession of time spans;

transferring said toner images from the image carrier to an intermediate transfer member to form thereon in each of a number of successive time intervals a respective plurality of toner image pages, wherein each toner image page represents a registered superposition of a respective plurality of said toner images, and the pages of each respective plurality of pages are spaced from each other along a moving direction of the intermediate transfer member and comprise a first page and a last page;

transferring said toner image pages from the intermediate transfer device to a recording medium; and cleaning said intermediate transfer member by contacting the member with a cleaning device after the last toner image for a given one of said plurality of toner image pages has been transferred from the image forming device to the intermediate transfer member but before the first toner image page of the same plurality of toner pages has reached the cleaning device, and spacing the cleaning device from the intermediate transfer member after the last toner image page of the same plurality of toner image pages has moved past the cleaning device and after a plurality of toner images for the next-in-time plurality of toner image pages has been transferred from the image carrier to the intermediate transfer member but before the start of the transfer from the image carrier to the intermediate transfer member of another plurality of toner images for said next-in-time plurality of toner image pages.

8. A method as in claim 7 in which said contacting starts at a selected time duration before the first toner image page of said given plurality of pages on the intermediate transfer member reaches the cleaning device, and said cleaning device is spaced from the intermediate transfer member a selected time duration after the last toner image page of the same plurality has moved past the cleaning device, wherein said time durations are selected to avoid a transfer of residual or floating toner to said recording medium and interference with said transfer of the toner images and of toner image pages due to the cleaning device making and breaking contact with the intermediate transfer member.

* * * * *